US012429288B2

(12) United States Patent
Khrustalev et al.

(10) Patent No.: US 12,429,288 B2
(45) Date of Patent: Sep. 30, 2025

(54) ARCHITECTURE AND OPERATIONAL MODES OF PUMP-AUGMENTED LOOP HEAT PIPE WITH MULTIPLE EVAPORATORS

(71) Applicant: The Government of the United States of America, as represented by the Secretary of the Navy, Arlington, VA (US)

(72) Inventors: Dmitry Khrustalev, Woodstock, MD (US); Timothy Holman, Alexandria, VA (US); Robert Baldauff, Mechanicsville, MD (US)

(73) Assignee: The Government of the United States of America, as represented by the Secretary of the Navy, Arlington, VA (US)

( * ) Notice: Subject to any disclaimer, the term of this patent is extended or adjusted under 35 U.S.C. 154(b) by 0 days.

(21) Appl. No.: 17/353,712

(22) Filed: Jun. 21, 2021

(65) Prior Publication Data

US 2021/0396477 A1 Dec. 23, 2021

Related U.S. Application Data

(60) Provisional application No. 63/040,970, filed on Jun. 18, 2020.

(51) Int. Cl.
*F28D 15/04* (2006.01)
*F28D 15/02* (2006.01)

(52) U.S. Cl.
CPC ..... *F28D 15/043* (2013.01); *F28D 15/0266* (2013.01); *F28D 2015/0291* (2013.01)

(58) Field of Classification Search
CPC .... F28D 15/04; F28D 15/043; F28D 15/0266; F28D 2015/0291; F28D 15/06; F28D 15/025; F28D 15/0258; F28F 27/02
See application file for complete search history.

(56) References Cited

U.S. PATENT DOCUMENTS

| | | | | |
|---|---|---|---|---|
| 8,567,486 | B1 * | 10/2013 | Wolf, Sr. | F28D 15/043 165/274 |
| 2006/0279706 | A1 * | 12/2006 | Bash | G03B 21/18 353/54 |
| 2018/0135503 | A1 * | 5/2018 | Ernst | F01P 7/165 |
| 2020/0067376 | A1 * | 2/2020 | Judge | H02K 5/225 |
| 2020/0124354 | A1 * | 4/2020 | Dupont | F28D 15/046 |

* cited by examiner

*Primary Examiner* — Harry E Arant
(74) *Attorney, Agent, or Firm* — US Naval Research Laboratory

(57) ABSTRACT

A pump-augmented Loop Heat Pipe (LHP) includes a conventional LHP evaporator/reservoir assembly; one or more additional evaporators; a condenser; a condenser bypass; and a pump upstream of the condenser and condenser bypass and configured to pump fluid generally toward the one or more additional evaporators.

13 Claims, 2 Drawing Sheets

ARCHITECTURE AND OPERATIONAL MODES OF PUMP-AUGMENTED LOOP HEAT PIPE WITH MULTIPLE EVAPORATORS

RELATED APPLICATIONS

This application claims the benefit of U.S. Provisional Application No. 63/040,970 filed Jun. 18, 2020, which is hereby incorporated herein by reference.

FEDERALLY-SPONSORED RESEARCH AND DEVELOPMENT

The United States Government has ownership rights in this invention. Licensing inquiries may be directed to Office of Technology Transfer, US Naval Research Laboratory, Code 1004, Washington, D.C. 20375, USA; +1.202.767.7230; techtran@nrl.navy.mil, referencing NC 111922.

FIELD OF INVENTION

The present invention relates generally to loop heat pipes, and more particularly to a pump-augmented loop heat pipe with multiple evaporators.

BACKGROUND

In addition to conventional Loop Heat Pipes (LHPs) with one capillary evaporator, various authors have presented so-called hybrid LHPs with a mechanical pump and with several capillary evaporators where the pressure differential for the vapor flow in the transport line and condenser are still supported by the capillary action of the porous wick inside the evaporators.

SUMMARY OF INVENTION

One shortcoming of the hybrid loop configurations mentioned above is that the pressure drop supporting the two-phase flow is still restricted by the capillary potential of the primary porous wick, which limits selection of the working fluids and the operating temperature ranges.

Conventional LHPs also have several disadvantages (versus this invention):

1. LHP can practically have only one (possibly two) LHP evaporators, where each evaporator is attached to a bulky reservoir. Thus a LHP cannot cool multiple distributed heat sources.
2. Conventional LHP heat transport capability for space applications is practically limited to 1.5 kW, whereas modern applications require much higher power transport.
3. Heat fluxes on the surface of conventional LHP evaporators are limited to 25 W/cm2.
4. LHP evaporator can be compromised (for example by particulate clogging the porous wick) rendering the LHP non-operational.
5. LHPs assortment of working fluids is limited to only those that have very steep saturation curves, since the capillary pumping of the LHP evaporator is due to the properties of the saturated fluid itself.
6. Orientations of LHPs during ground operation (in the field of gravity) are restrictive, which creates inconveniences during spacecraft-level ground-testing.

Thus, described herein is an invention to create a new class of Loop Heat Pipes (LHPs), which would possess higher heat transport capability, be capable of cooling multiple distributed heat sources, and withstand higher heat fluxes on the surfaces of multiple evaporators, while preserving the best features of Loop Heat Pipe technology.

Conventional LHPs and exemplary Pump-Augmented LHPs (PA-LHPs) both have the reservoir integrated with the LHP evaporator. This is one significant feature that distinguishes exemplary PA-LHPs from other kinds of mechanically-pumped two-phase systems where the reservoir is not integrated with a LHP evaporator.

According to one aspect of the invention, a pump-augmented Loop Heat Pipe (LHP) includes a conventional LHP evaporator/reservoir assembly; one or more additional evaporators; a condenser; a condenser bypass; and a pump upstream of the condenser and condenser bypass and configured to pump fluid generally toward the one or more additional evaporators.

Optionally, the pump-augmented LHP includes a fluid transport line that bypasses the conventional LHP evaporator/reservoir assembly, the one or more additional evaporators being situated along this fluid transport line; and a check valve downstream of the pump and upstream of the one or more additional evaporators.

Optionally, the pump is located upstream of the conventional LHP evaporator/reservoir assembly.

Optionally, the pump is located parallel to the conventional LHP evaporator/reservoir assembly in a fluid transport line bypassing the conventional LHP evaporator/reservoir assembly.

Optionally, the pump-augmented LHP is configured to operate as a conventional LHP when the pump is off.

Optionally, the pump-augmented LHP is configured to operate as a mechanically pumped two-phase system when there is no heat load on an evaporator of the conventional LHP evaporator/reservoir assembly.

Optionally, the pump-augmented LHP is configured to operate as a conventional LHP and as a mechanically pumped two-phase system simultaneously.

Optionally, the one or more additional evaporators are high-heat flux evaporators relative to conventional LHP evaporators.

Optionally, the pump-augmented LHP is configured to acquire thermal energy from multiple distributed heat sources via the one or more additional evaporators and transport the thermal energy to the condenser via mechanical pumping.

Optionally, fluid at a liquid intake of the pump is always single-phase liquid due to the condenser bypass.

Optionally, the pump-augmented LHP includes a subcooler upstream of a liquid intake of the pump configured to cool the pump with liquid pumped by the pump.

Optionally, the pump-augmented LHP includes a second pump, wherein the pumps are in series and are rotodynamic pumps.

The foregoing and other features of the invention are hereinafter described in greater detail with reference to the accompanying drawings.

DETAILED DESCRIPTION

Figure 1:
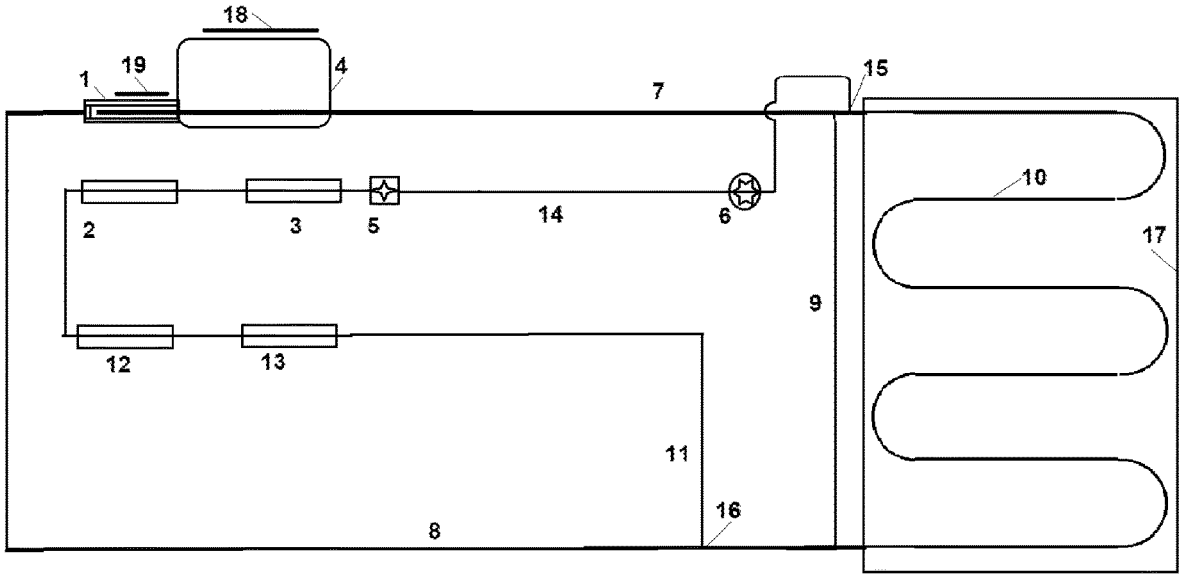
FIG. 1 shows a schematic diagram of an exemplary pump-augmented loop heat pipe.

Described herein and with initial reference to FIG. 1 is a new Loop Heat Pipe class, which is different from conventional Loop Heat Pipes (LHP) as it includes several additional components: at least one Mechanical Pump 6, Check Valve 5, high heat flux evaporators 2, 3, 12, 13, condenser bypass 9, and a fluid transport line 11 for the pump to move fluid to/from several evaporators (see FIG. 1). Exemplary Pump-Augmented LHPs (PA-LHPs) can operate with multiple evaporators, at higher total power levels than conventional LHPs to transport thermal energy to the condenser/radiator, and with much higher heat fluxes on the evaporators than conventional LHPs, due to the two-phase fluid being moved by the mechanical pumping. Such PA-LHP can operate as a conventional LHP and as a mechanically-pumped two-phase system, which utilizes a typical commercially available LHP-type Reservoir-Evaporator assembly. It also can operate with both LHP-mode and mechanically-pumped mode utilized simultaneously.

Conventional LHP operation. Exemplary PA-LHP configurations can operate as a conventional LHP (without mechanical pumping), where components 2, 3, 5, 6, and 11-14 are not in use. External heating of a LHP evaporator 1, shown in FIG. 1, evaporates working fluid (liquid) inside the evaporator primary porous wick. Capillary pressure, developed by the primary wick, pushes the vapor flow into the vapor transport line 8 and further into condenser tubing 10, which is attached to the condenser plate 17 cooled externally by a heat sink. Vapor is normally fully condensed inside condenser 10 and cold liquid is coming out of the condenser into the liquid return line 7 is usually colder than the saturation temperature of the reservoir 4. Liquid entering the reservoir 4 through the liquid transport line 7 cools the reservoir to some extent, compensating for the reservoir heating due to the internal heat leak from the evaporator 1 to the reservoir 4, which allows the reservoir to reach a steady state operational temperature. The system shown in FIG. 1 can operate as a conventional LHP whenever the mechanical pump is turned off. For such mode the check valve 5 is necessary in order to prevent the vapor coming from the LHP evaporator 1 to flow through the mechanical pump 6 returning back to the reservoir 4. This operational mode can be used to prime the mechanical pump with liquid prior to turning it on, as well as to cool a payload thermally coupled with the LHP evaporator 1.

Mechanically-pumped two-phase operation. The system schematically shown in FIG. 1 can operate in purely mechanically pumped mode where mechanical pump 6 pushes liquid through several high heat flux evaporators 2, 3, 12, and 13 and the LHP evaporator 1 is not heat loaded. For this operational mode, the two-phase pumped system is essentially utilizing a conventional LHP reservoir assembly 1, 4, which includes all intrinsic components used for conventional LHPs. Operation of such conventional LHP evaporator/reservoir assembly is well understood in the industry and has a vast space flight heritage. Utilizing this evaporator/reservoir assembly for the mechanically-pumped operational mode as a commercially available building block is a convenience and an innovation. It also provides additional benefits for operating the pumped two-phase system in FIG. 1:

(a) LHP evaporator 1 can be heat loaded using electrical heater 19 to initiate liquid flow through the mechanical pump prior to turning it on, (b) Electrical heater 18, positioned on the reservoir 4, can be used to increase temperature and pressure of the saturated vapor inside the reservoir, which can be done in any orientation due to the existing capillary structures inside LHP reservoirs, (c) Electrical heater 19, positioned on the evaporator 1, can be used as needed to decrease temperature and pressure of the saturated vapor inside the reservoir by bringing in cold liquid into the reservoir through the liquid transport line 7.

Since a mechanical pump typically needs to have single-phase liquid in its intake manifold, an exemplary PA-LHP also includes a condenser bypass small diameter tubing 9, which ensures that only single-phase subcooled liquid flows out of the condenser 10.

Utilizing such condenser bypass in the proposed PA-LHP allows to keep the reservoir 4 far from the radiator and remotely from the mechanical pump 6, which is beneficial for the flight system integration as well as to reduce electrical power consumption needed for the reservoir temperature control with heater 18.

Combined LHP mode and Mechanically-pumped two-phase operation. The two-phase system shown in FIG. 1 can operate with all evaporators heat loaded simultaneously, including the LHP evaporator 1 and "pumped" evaporators 2, 3, 12, and 13. Pressure drop $dP_{_LHP}$ due to the vapor flow from LHP evaporator 1 to point 16 near the condenser inlet is sustained by the capillary pressure developed in the evaporator primary wick. Pressure drop $dP_{_pumped}$ between points 15 at the pump inlet and point 16 near the condenser inlet is provided by the mechanical pump 6. For a steady state operation to be stable, these two pressure drops should be equal. There are two pressure equalizing mechanisms in such an exemplary PA-LHP: (a) capillary pressure in the LHP evaporator primary wick is self-adjusting, which is the main principle of LHP operation, and (b) the liquid flow rate provided by the mechanical pump is variable and is controlled by an electronic controller with a corresponding algorithm programmed to keep the pumped fluid pressure drop $dP_{_pumped}$ within certain acceptable range from the pressure drop $dP_{_LHP}$.

A significant benefit of the exemplary PA-LHP shown in FIG. 1 is that additional pumped evaporators 2, 3, 12, and 13 can cool multiple distributed heat sources in addition to that cooled by the LHP evaporator, significantly increasing the total energy transport capability of the LHP by combining it with the mechanically-pumped fluid path between points 15 and 16. Additionally, the pumped evaporators 2, 3, 12, and 13 can withstand much higher heat fluxes than a conventional LHP evaporator, which is typically restricted by the heat flux of 25 $W/cm^2$ on the evaporator surface.

Figure 2:
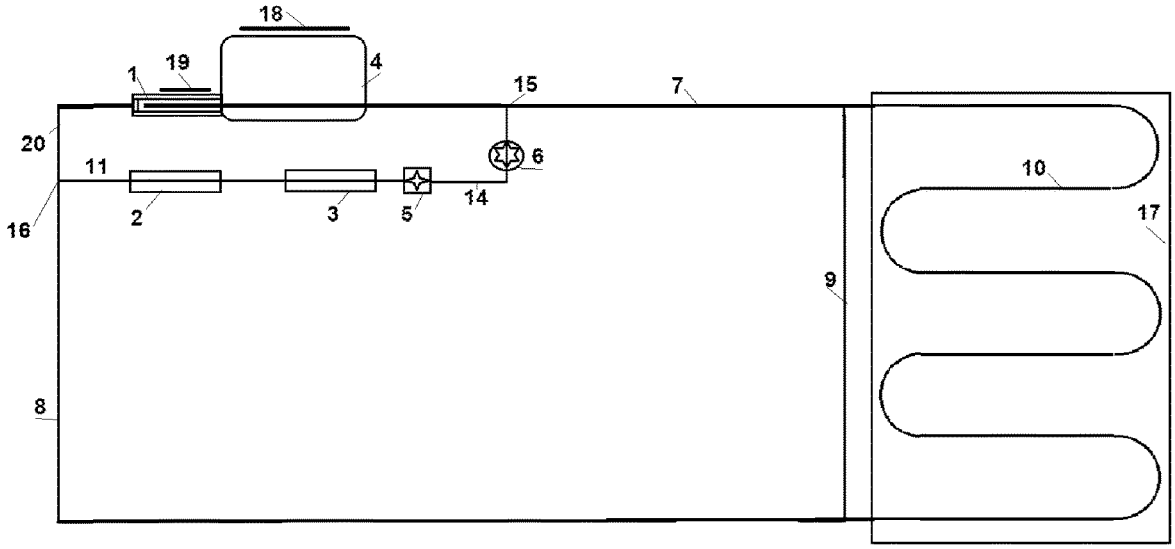
FIG. 2 shows a schematic diagram of another exemplary pump-augmented loop heat pipe.

A second exemplary embodiment of a PA-LHP is shown in FIG. 2. One difference it has versus that illustrated in FIG. 1 is that the liquid suction point 15 for the mechanical pump 6 is located on the liquid return line 7 and can be in the vicinity of the reservoir 4 for a more effective integration into the application system. Another difference is that the fluid path between points 15 and 16 is much shorter and is essentially going around the evaporator/reservoir assembly 1, 4.

Note that in the second exemplary PA-LHP schematic in FIG. 2 the mechanical pump 6 can fully compensate for the entire pressure drop between path flow points 15 and 16, including the vapor flow in the transport line 8. Such arrangement allows the evaporators to operate with elevated heat loads, which for a conventional LHP are severely restricted by viscous and dynamic pressure drops across the vapor line and condenser versus the LHP evaporator capillary pressure. Note that LHP evaporators cannot practically use submicron wicks with pore radius less than 0.5 microns due to very low permeability of such wicks, whereas a PA-LHP can use extremely small pore radius LHP wick (for example several times smaller than 0.5 microns) if the heat load on the LHP evaporator is small but the heat load on other evaporators is very high.

Figure 3:
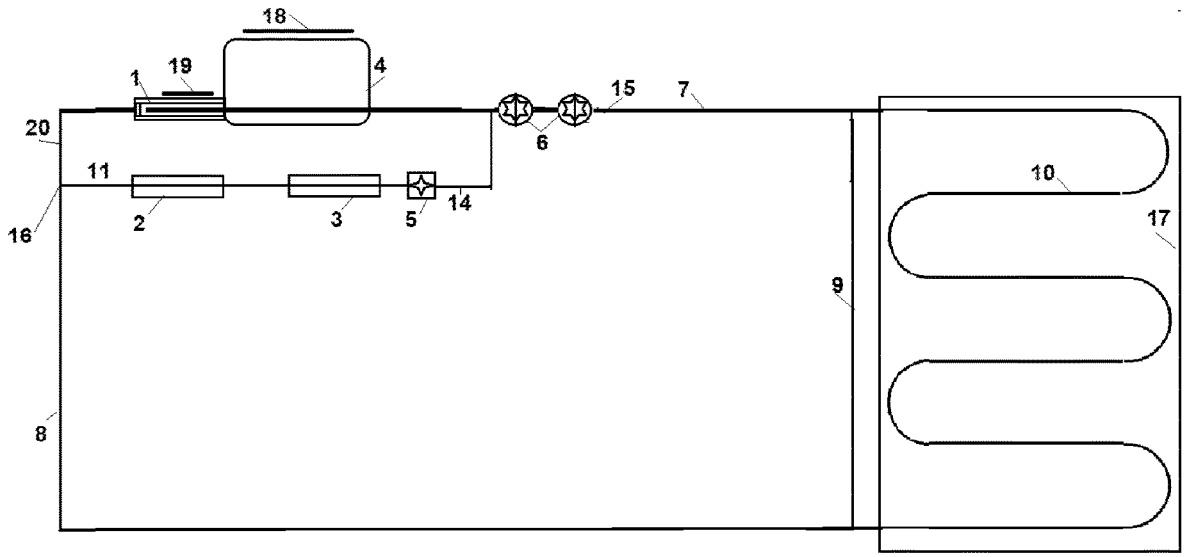
FIG. 3 shows a schematic diagram of another exemplary pump-augmented loop heat pipe.

A third exemplary embodiment of a PA-LHP is shown in FIG. 3. The main difference it has versus that in FIG. 2 is that the mechanical pump (6) is directly plugged into the liquid return line 7. Thus the liquid is forced through the pumped evaporators 2 and 3 and also in parallel through the LHP evaporator/reservoir assembly 1, 4. Note that the liquid flow through the LHP evaporator is minimal due to the low permeability primary wick and also a very small diameter of the evaporator outlet vapor line 20. Another difference is that two or more mechanical rotodynamic pumps can be used in series for redundancy, as such pumps typically have very low flow-through resistance. Also the system redundancy is much higher than that of a simple LHP (without mechanical pump) due to the pumped evaporators 2 and 3 being fully capable of cooling the payload even if the LHP evaporator with micron-size pores is non-operational (for example clogged with particulate).

At least one thousand conventional LHPs are being used for thermal control of commercial (as well as military) satellites. There is a demand for higher-power LHP-type systems for high-power satellites. This invention (PA-LHPs) will cover multiple future applications for both commercial and DOD satellites.

While preserving the heritage and the best features of the well-established Loop Heat Pipe Technology, this invention proposes to add mechanical pump(s) to the LHP, making it a Pump-Augmented LHP (PA-LHP) and provides the following advantages versus conventional LHPs:

1. PA-LHP can have several additional flow-through evaporators supplied with liquid by the mechanical pump, which can cool distributed heat sources.
2. PA-LHP heat transport capability can be much higher (several times) than that of a conventional LHP due to the pump being capable of generating higher pressure drops than the capillary potential of LHP primary wicks (typically one micron pore radius).
3. The additional flow through evaporators in PA-LHPs can withstand higher heat fluxes versus LHP evaporators (useful for modern applications) because they are mechanically pumped and the liquid is forced through.
4. PA-LHPs possess better reliability than LHPs since PA-LHP can operate even if either the LHP evaporator is clogged or if the mechanical pump is non-operational.
5. PA-LHPs allow to cover more applications due to their higher power, versatility, and flexibility of placing and integrating components on the applications platforms (only one reservoir does not have to be co-located).
6. PA-LHPs can use a wider range of working fluids as compared to LHPs, since the pressure drop is generated mainly by the mechanical pump (for example R134a can be used in PA-LHP, however its use in LHPs is not efficient).

Although the invention has been shown and described with respect to a certain embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A pump-augmented Loop Heat Pipe (LHP), comprising:

a first evaporator constructed to receive external heat and evaporate a working fluid;

a reservoir integrated with the first evaporator;

a vapor transport line connected to the first evaporator;

a condenser connected to the vapor transport line;

a liquid return line connected to the condenser and the reservoir;

a fluid transport line connected to the liquid return line and the vapor transport line;

a pump;

a plurality of evaporators situated along the fluid transport line; and a check valve situated along the fluid transport line and arranged to supply a liquid received from the pump directly to the plurality of evaporators situated along the fluid transport line, wherein the pump-augmented LHP is constructed to operate in:

a first mode where the check valve is closed and the pump off such that:

(i) evaporated working fluid, evaporated by the first evaporator, is received by the vapor transport line and provided to the condenser, (ii) the condenser condenses the evaporated working fluid, evaporated by the first evaporator, into a liquid working fluid and provides the liquid working fluid to the liquid return line, and (iii) the liquid working fluid provided to the liquid return line is supplied to the reservoir, and a second mode where the check valve is open and the pump is on such that:

(i) the evaporated working fluid, evaporated by the first evaporator, is received by the vapor transport line and provided to the condenser, (ii) evaporated working fluid, evaporated by the plurality of evaporators situated along the fluid transport line, is also received by the vapor transport line and provided to the condenser, (iii) the condenser condenses the evaporated working fluid evaporated by the first evaporator and the evaporated working fluid evaporated by the plurality of evaporators situated along the fluid transport line into a liquid working fluid and provides the liquid working fluid to the liquid return line and fluid transport line, (iv) the liquid working fluid provided to the liquid return line is supplied to the reservoir, and (v) the liquid working fluid provided to the fluid transport line is pumped by the pump through the check valve and directly to the plurality of evaporators situated along the fluid transport line.

2. The pump-augmented LHP of claim 1, further comprising:

a subcooler upstream of a liquid intake of the pump configured to cool the pump with liquid pumped by the pump.

3. The pump-augmented LHP of claim 1, further comprising:

a second pump, wherein the pump and the second pump are in series and are rotodynamic pumps.

4. The pump-augmented LHP of claim 1, wherein the pump is situated along the fluid transport line.

5. The pump-augmented LHP of claim 1, wherein the plurality of evaporators situated along the fluid transport line are constructed to receive respective external heat loads.

6. The pump-augmented LHP of claim 5, wherein the plurality of evaporators are constructed to evaporate liquid working fluid in the fluid transport line in accordance with the received respective external heat loads.

7. The pump-augmented LHP of claim 1, further comprising:

a condenser bypass connected to the liquid return line and the vapor transport line.

8. The pump-augmented LHP of claim 1, further comprising:

a condenser bypass connected to the liquid return line and the vapor transport line.

9. A pump-augmented Loop Heat Pipe (LHP), comprising:

a first evaporator constructed to receive external heat and evaporate a working fluid;

a reservoir integrated with the first evaporator;

a vapor transport line connected to the first evaporator;

a condenser connected to the vapor transport line;

a liquid return line connected to the condenser and the reservoir;

a fluid transport line connected to the liquid return line and the vapor transport line;

a pump situated along the liquid return line;

a plurality of evaporators situated along the fluid transport line; and a check valve situated along the fluid transport line and arranged to supply a liquid received from the pump directly to the plurality of evaporators situated along the fluid transport line;

wherein the pump-augmented LHP is constructed to operate in:

a first mode where the check valve is closed such that:

(i) evaporated working fluid, evaporated by the first evaporator, is received by the vapor transport line and provided to the condenser, (ii) the condenser condenses the evaporated working fluid, evaporated by the first evaporator, into a liquid working fluid and provides the liquid working fluid to the liquid return line, and (iii) the liquid working fluid provided to the liquid return line is supplied to the pump which then supplies the liquid working fluid to the reservoir, and a second mode where the check valve is open such that:

(i) the evaporated working fluid, evaporated by the first evaporator, is received by the vapor transport line and provided to the condenser, (ii) evaporated working fluid, evaporated by the plurality of evaporators situated along the fluid transport line is also received by the vapor transport line and provided to the condenser, (iii) the condenser condenses the evaporated working fluid evaporated by the first evaporator and the evaporated working fluid evaporated by the plurality of evaporators situated along the fluid transport line into a liquid working fluid and provides the liquid working fluid to the liquid return line and fluid transport line, (iv) the liquid working fluid provided to the liquid return line is supplied to the reservoir, and (v) the liquid working fluid provided to the fluid transport line is pumped by the pump through the check valve and directly to the plurality of evaporators situated along the fluid transport line.

10. The pump-augmented LHP of claim 9, further comprising:

a subcooler upstream of a liquid intake of the pump configured to cool the pump with liquid pumped by the pump.

11. The pump-augmented LHP of claim 9, further comprising:

a second pump, wherein the pump and the second pump are in series and are rotodynamic pumps.

12. The pump-augmented LHP of claim 9, wherein the plurality of evaporators situated along the fluid transport line are constructed to receive respective external heat loads.

13. The pump-augmented LHP of claim 12, wherein the plurality of evaporators are constructed to evaporate liquid working fluid in the fluid transport line in accordance with the received respective external heat loads.

* * * * *